US006032292A

United States Patent [19]

Wood et al.

[11] Patent Number: 6,032,292

[45] Date of Patent: Mar. 7, 2000

[54] CONVERTIBLE BANDANNA OR SCARF

[76] Inventors: Chester James Wood; Betty Jane Wood, both of 7794 La Casa Way, Buena Park, Calif. 90620

[21] Appl. No.: 09/240,157

[22] Filed: Jan. 29, 1999

Related U.S. Application Data

[60] Provisional application No. 60/100,064, Sep. 12, 1998.

[51] Int. Cl.[7] ..... A41D 23/00

[52] U.S. Cl. ..... 2/207; 2/9; 2/206; 2/209.13; 351/155

[58] Field of Search ..... 2/171, 207, 9, 2/10, 206, 209.13; 351/155, 157

[56] References Cited

U.S. PATENT DOCUMENTS

| | | | |
|---|---|---|---|
| 766,963 | 8/1904 | Murray . | |
| 825,170 | 7/1906 | Allen . | |
| 2,883,670 | 4/1959 | Pratt | 2/207 |
| 3,237,210 | 3/1966 | Graber . | |
| 3,449,766 | 6/1969 | Garber et al. . | |
| 3,768,100 | 10/1973 | Colman et al. . | |
| 3,878,563 | 4/1975 | Pulju . | |
| 4,095,290 | 6/1978 | O'Brien . | |
| 4,300,240 | 11/1981 | Edwards . | |
| 4,593,417 | 6/1986 | Brown, Jr. et al. . | |
| 4,641,380 | 2/1987 | Epstein . | |
| 4,993,080 | 2/1991 | Doty | 2/207 |
| 5,035,006 | 7/1991 | Hetz et al. . | |
| 5,058,211 | 10/1991 | Hanks | 2/207 |
| 5,685,016 | 11/1997 | Douglas | 2/171 |
| 5,706,802 | 1/1998 | McCormick . | |

*Primary Examiner*—Diana Oleksa
*Attorney, Agent, or Firm*—James G. O'Neill

[57] ABSTRACT

An improved bandanna or scarf is formed with holding elements thereon, and may include a number of flexible layers which provide protection from the elements. A top portion of the improved bandanna or scarf may include elastic elements to aid in securing the bandanna or scarf in place on the nose of a wearer, or may have a pair of drawstrings with locking elements to enable the bandanna or scarf to be adjustably tightened when wearing. The drawstrings may also include loops for supporting glasses thereon.

11 Claims, 5 Drawing Sheets

CONVERTIBLE BANDANNA OR SCARF

CROSS REFERENCE TO RELATED APPLICATIONS

This application claims the benefit of Provisional Application No. 60/100,064, filed Sep. 12, 1998.

BACKGROUND OF THE INVENTION

This invention generally relates to clothing, and, more particularly, to a bandanna or scarf, which may be used as a multi-purpose apparel accessory, such as a face and neck warmer, a neck warmer along, an ascot, or a shawl.

Many types of bandannas or scarves are known. However, these bandannas or scarves are normally secured around the neck or head of a wearer, as by tying, do not protect in all situations and are not convertible for multi-purpose use.

Accordingly, it is a general object of the present invention to provide an improved bandanna or scarf. It is a particular object of the present invention to provide an improved bandanna or scarf having means for changing the configuration of the bandanna or scarf. It is a still more particular object of the present invention to provide an improved square of material that may be formed into a bandanna or scarf, and which may include a plurality of layers, as well as means for supporting glasses or goggles, and means for adjusting the fit thereof.

These and other objects and advantages of the present invention are achieved by providing a flexible, rectangular piece of material, folded so as to form a bandanna or scarf, which includes a plurality of holding elements for securing the bandanna or scarf together around the back, neck or head of a person. The formed bandanna or scarf may also includes elastic portions and/or drawstrings to aid in more securely holding the bandanna or scarf on a wearer.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention, and sets forth the best modes contemplated by the inventors of carrying out their invention. Various modifications, however, will remain readily apparent to those skilled in the art, since the generic principles of the present invention have been defined herein, specifically to provide an explanation of a novel convertible bandanna or scarf 10.

Figure 6:
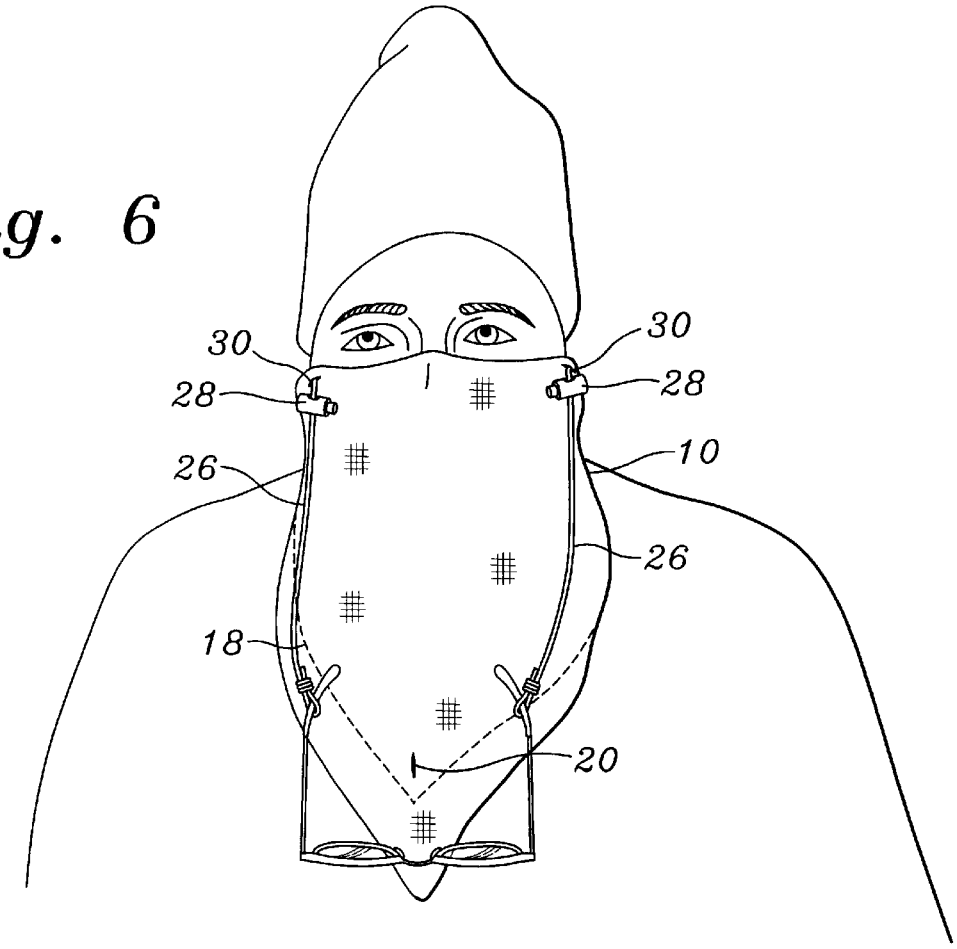
FIG. 6 is a front elevational view of the bandanna or scarf of FIG. 1, worn over the face and head of a user.
Figure 7:
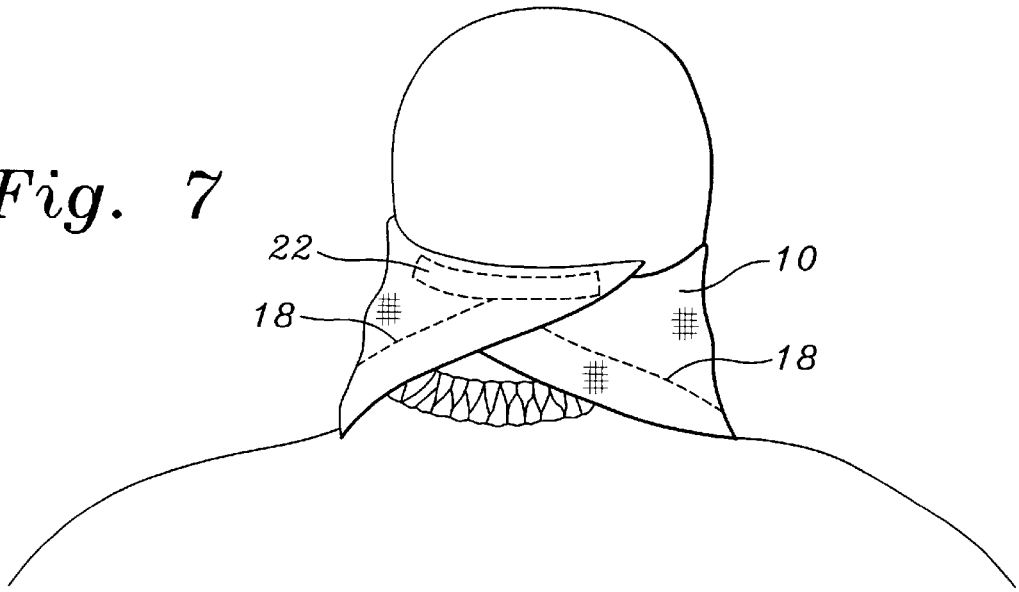
FIG. 7 is a rear elevational view of FIG. 6.
Figure 8:
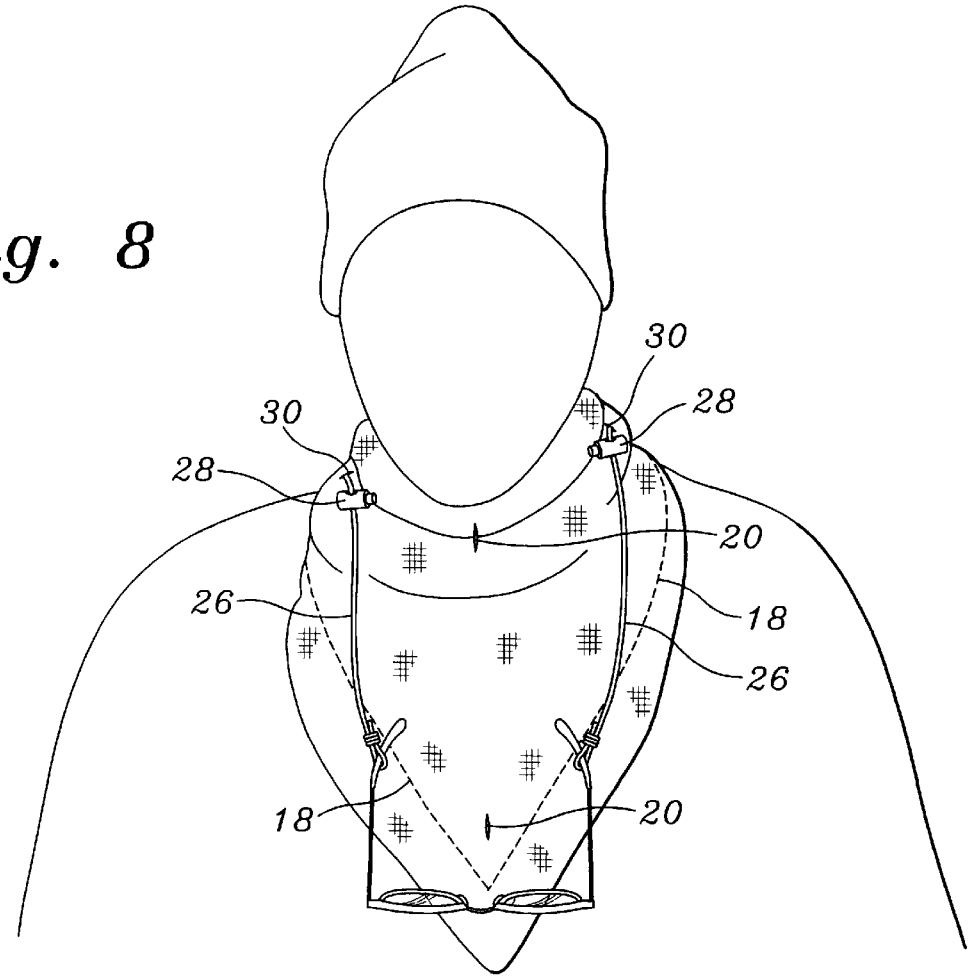
FIG. 8 is a front elevational view of the bandanna or scarf of FIG. 1, worn around the neck of a user.
Figure 9:
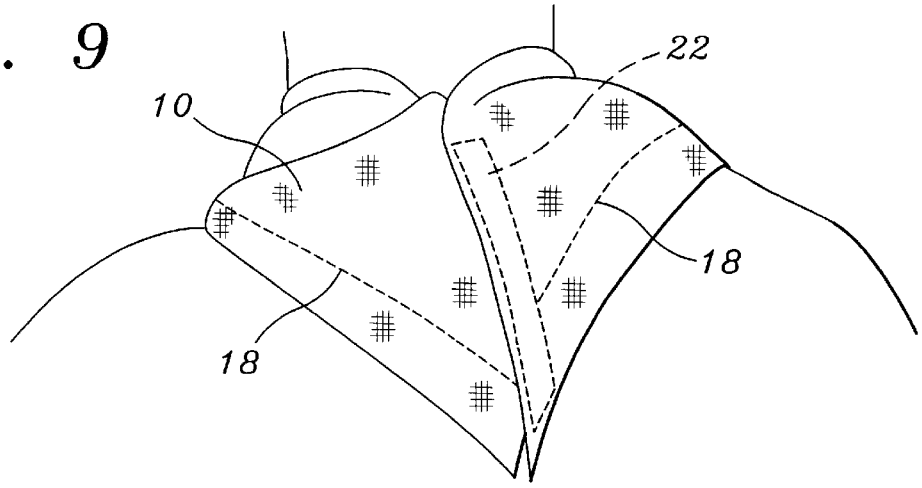
FIG. 9 is a rear elevational view of FIG. 8.

Turning now to the drawings, FIGS. 1–3 and 5 show one embodiment of the convertible bandanna or scarf 10 of the present invention, folded into a triangular configuration, ready to be worn by a person or user, in any desired manner. For example, the bandanna or scarf 10 may be worn as a face and neck warmer (see FIGS. 6 and 7), as decoration, or a neck warmer only (see FIGS. 8 and 9), or purely as a fashion statement, such as an ascot, shawl, or the like.

Figure 5:
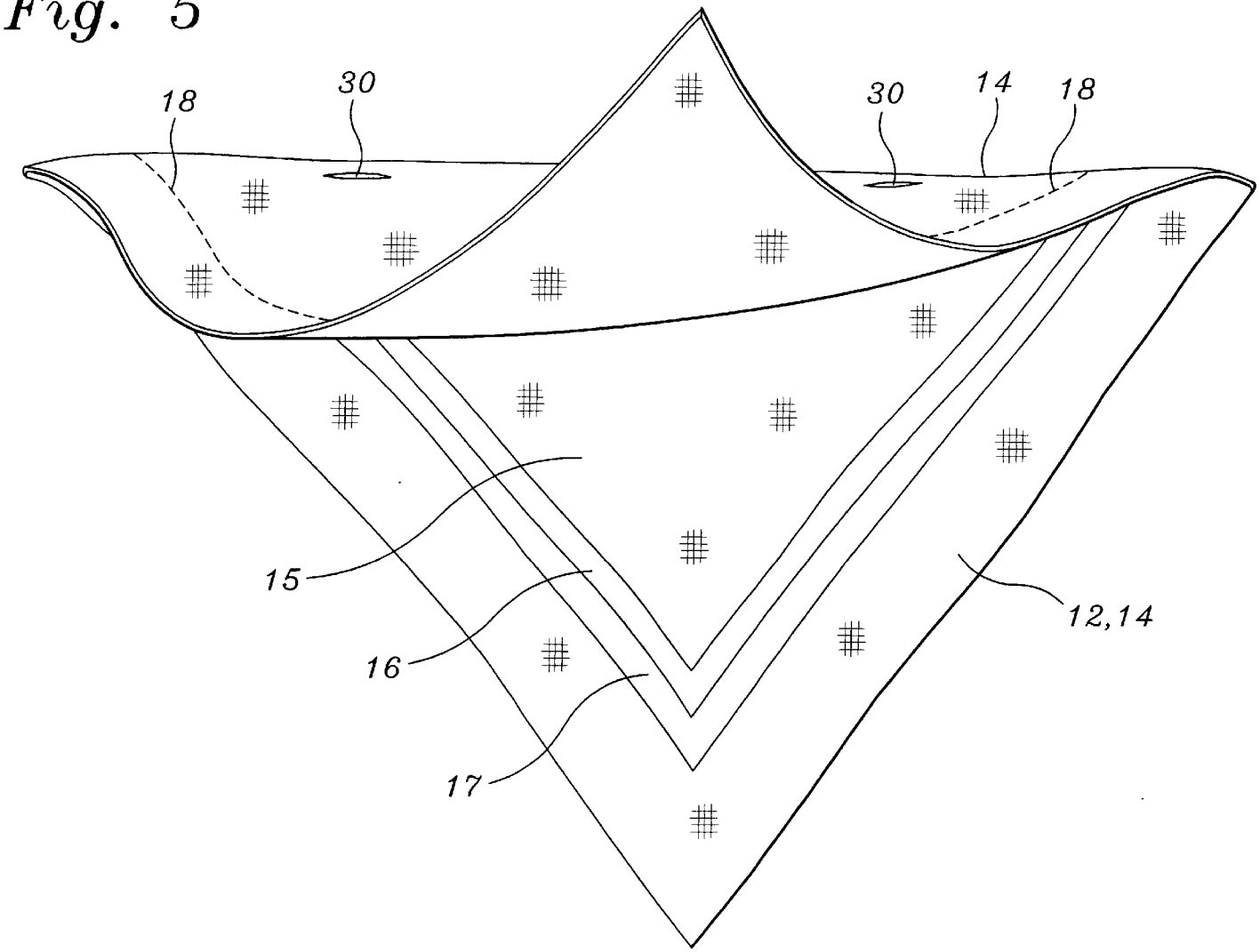
FIG. 5 is a front elevational view of a numbers of layers of material, partially folded, used to form the bandanna or scarf of FIG. 1.

As best shown in FIG. 5, the bandanna or scarf 10 is preferably a rectangular portion of material folded into a triangular shape, large enough to cover a wearer's face while overlapping at the back of the head. The rectangular portion of material is made from any desired material, such as cotton, polyester, or the like, and is sized and dimensioned, in accordance with its need or use. For example, the rectangular portion of material may have a plurality of layers, such as an inner layer 12, preferably of combed cotton, silk, or other soft material. This inner layer 12 may be of any shape, and is preferably worn against a wearer's skin for comfort. The rectangular portion of material may also include a water-resistant or water-repellent outer layer 14, secured to or sewn to the rectangular portion and the inner layer 12, to form the bandanna or scarf 10. The bandanna or scarf 10 may also consist of one or more further layers of various sizes and shapes between the inner layer 12 and outer layer 14. The outer layer 14 may be provided with fabric patterns of any kind, such as a southwestern or western design, plaid, camouflage, endorsement logos, etc.

To provide added warmth, one or more internal layers of a filtering or insulating material 15, 16, 17 (as needed), such as THERMOLAM®, can be secured to various areas of the bandanna or scarf to provide resistance against cold weather. Other filtering or insulating materials can also be used. In this fashion, the bandanna or scarf 10 can be worn for any type of outdoor activities, such as protection during skiing, snowboarding, snowmobiling, winter sporting events, etc.

The bandanna or scarf 10 can, of course, be assembled with no insulation using fabric only along with mechanical adjusting and securing features described below, to obtain proper fit. In this manner, the bandanna or scarf 10 can be used in hot or dusty climate conditions as a filter for dust and wind during activities, such as dirt-bike riding, horseback riding, bicycle riding, racing events, etc.

In one preferred embodiment of the present invention, two layers 12 and 14 and inner filter or insulation layers 15, 16, 17 (as needed), are secured together as by means of sewing perimeter stitches 18, approximately 2" from the outside edge on two sides and sealing the filter or insulating layers of material within the outer layers. Securing means, such as tack stitches 20, may be provided at the bottom and top center of the bandanna or scarf 10, to aid in keeping the layers 12 and 14 and the filter or insulation layers in place.

Figure 1:
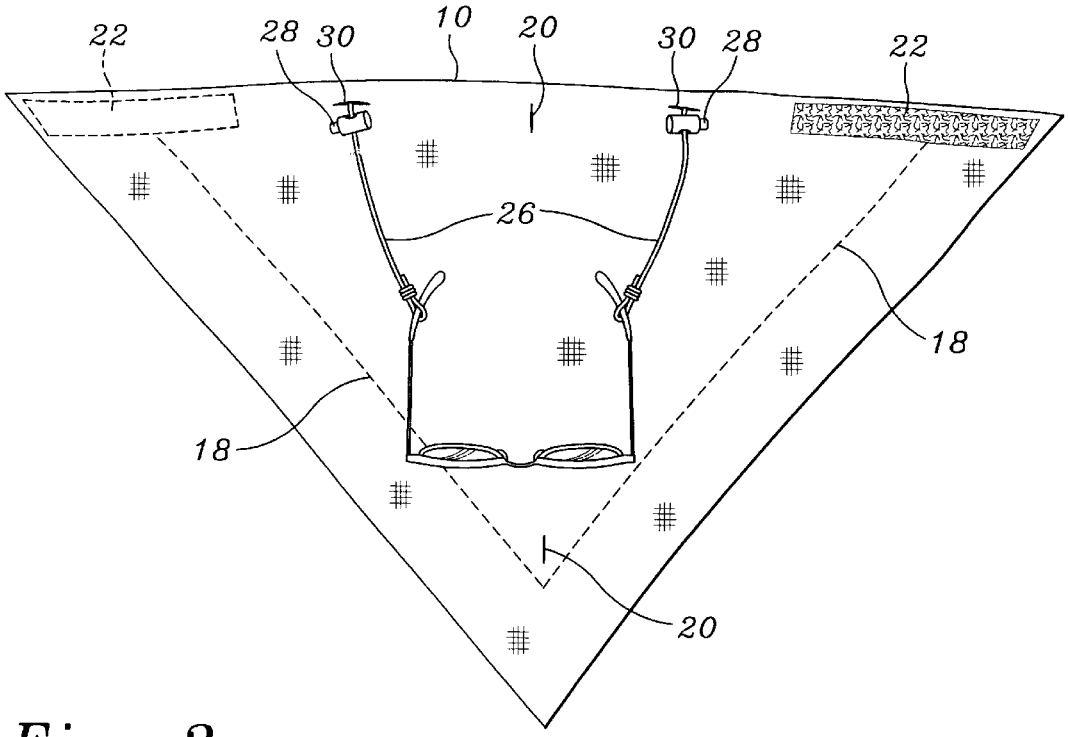
FIG. 1 is a front elevational view of one embodiment of an improved bandanna or scarf of the present invention, supporting glasses on a pair of drawstrings.
Figure 4:
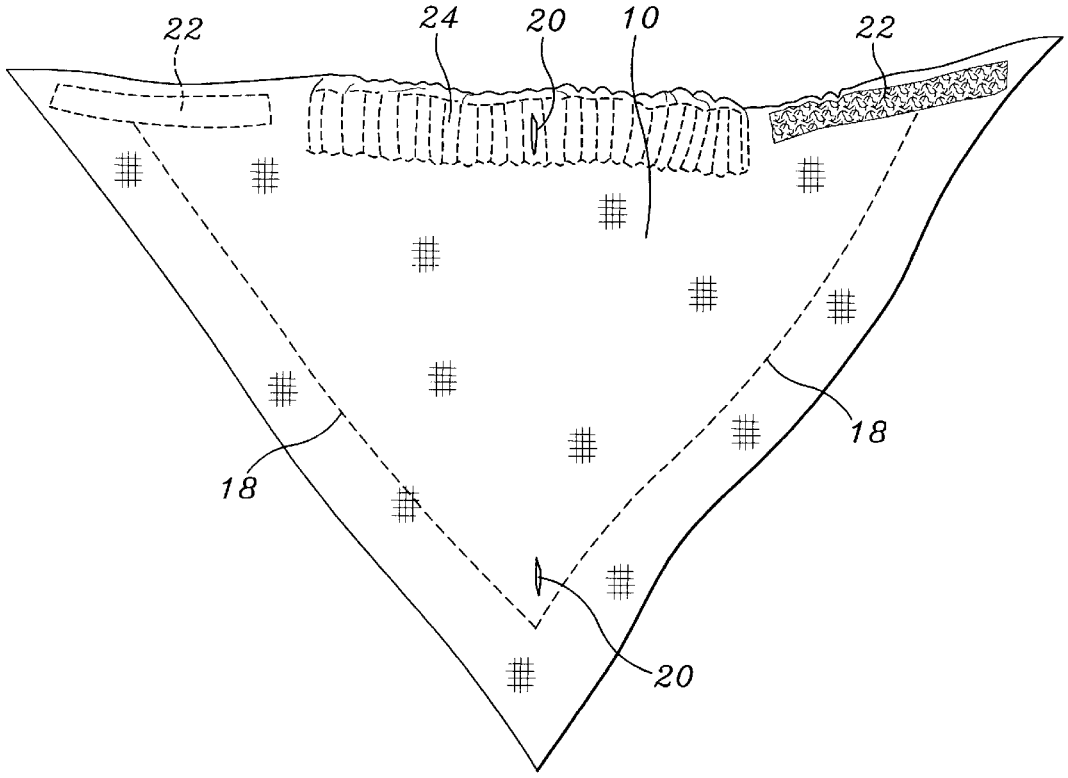
FIG. 4 is a front elevational view of a second embodiment of an improved bandanna or scarf, without drawstrings.

Holding or securing elements 22, such as buttons and holes, hook snaps or VELCRO® hook and loop fastening strips are secured to or sewn to opposed corners of the folded bandanna or scarf, along the top edge thereof, as illustrated in FIG. 1. As best shown in FIG. 4, the bandanna or scarf 10 can be adjusted for fit and comfort when on a wearer's face (see FIGS. 4 and 6), by the use of elastic strips 24. The elastic strips are preferably secured along the top edge or portion in a folded bandanna or scarf 10, along a central area that will cover a wearer's nose during use. This provides the bandanna or scarf 10 with ease of adjustment simply by securing it tighter or more loosely to the face by adjustment of the securing elements. In this manner, the bandanna or scarf 10 can also be made reversible.

Figure 2:
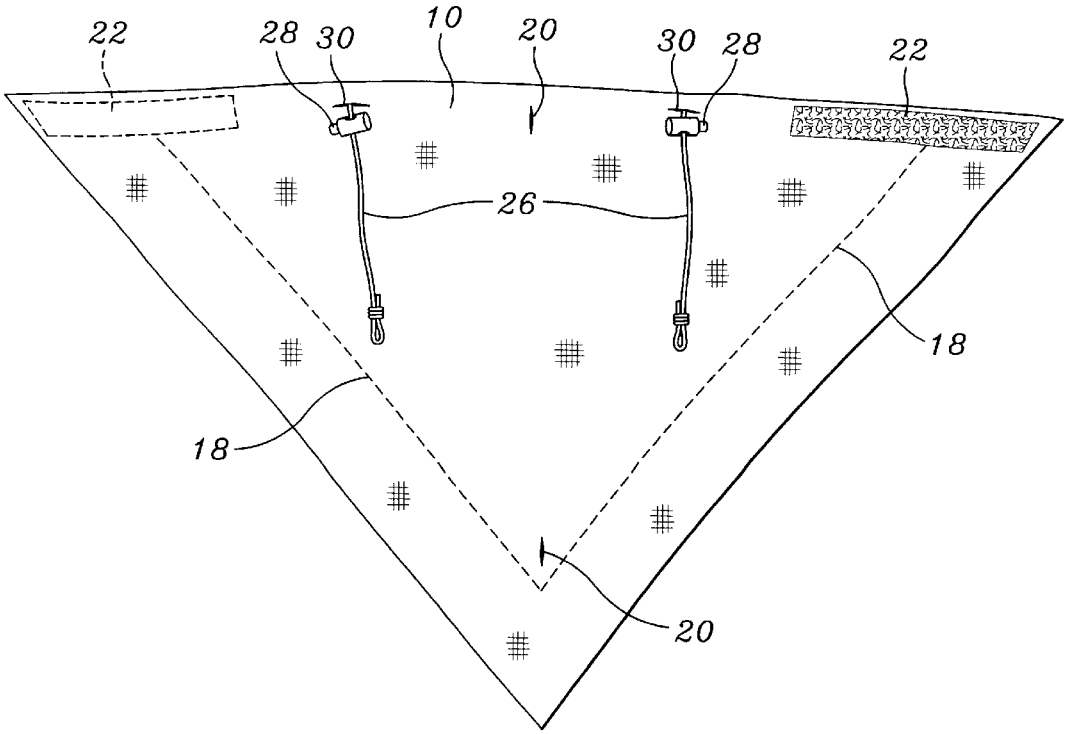
FIG. 2 is a further front elevational view of the bandanna or scarf of FIG. 1, with the glasses removed.
Figure 3:
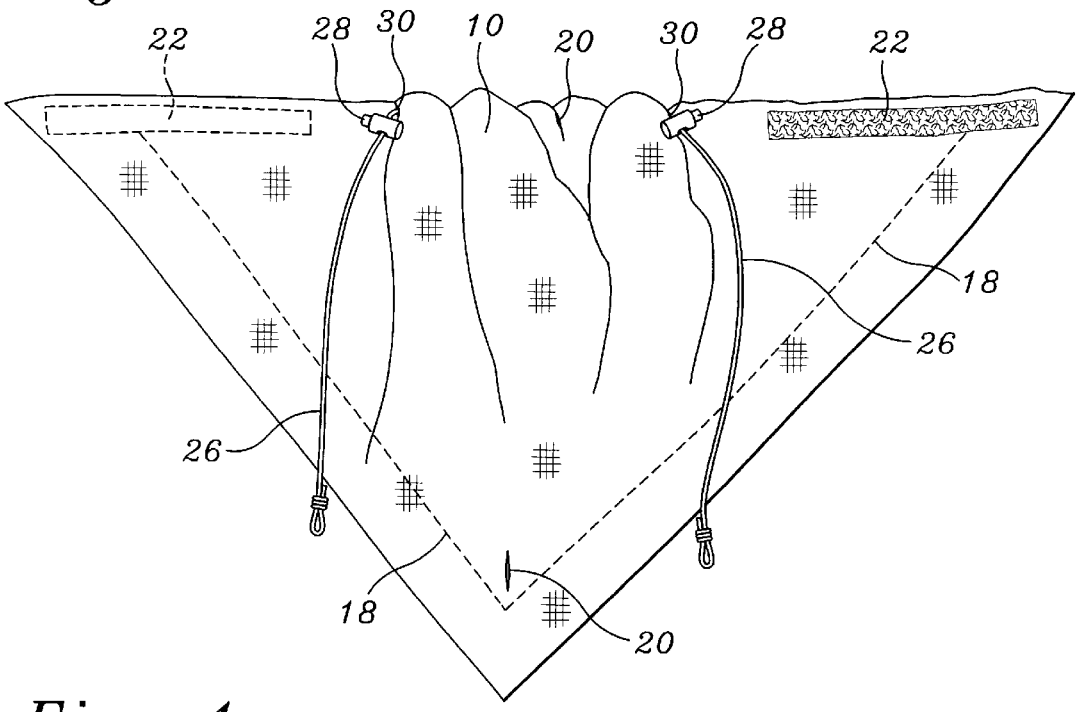
FIG. 3 is a further front elevational view, similar to FIG. 2, with the drawstrings pulled to tighten a central portion of the bandanna or scarf.

With the above-described embodiment, the bandanna or scarf 10 does not need any other adjusting means. However, if no elastic strips are used, as shown in FIGS. 1–3, 6 and 8, the bandanna or scarf 10 can be adjusted by the use of drawstrings 26. These drawstrings may include cord clamps 28 (U.S. Pat. No. 4,328,605). One end of each of the drawstrings 26 are preferably held in place, as by being tack stitched at a point 20 midway along the top edge or portion of the folded bandanna or scarf 10. The drawstrings 26 pass out through openings or buttonholes 30, formed on each side of the bandanna or scarf, approximately half the distance from the center, as illustrated in FIGS. 2 and 3. By using cord clamps 28 to hold the drawstrings in place, the fabric of the bandanna or scarf 10 can be drawn up or tightened for added comfort and fit, and held in place, as best illustrated in FIG. 3. The drawstrings 26 also include end loops, which serve as holders for goggles, sunglasses or eyeglasses. The bandanna or scarf 10 has an endless market potential for advertising.

Accordingly, as will be apparent to those skilled in the art, the present invention provides a distinctive bandanna or scarf, which is easily formed and then worn by a user, folded with the ends secured together, either around a person's face or around the person's neck. In addition, when the bandanna or scarf is on a person's face, or around their neck, drawstrings may be tightened to more securely hold the same in place. Finally, the bandanna or scarf may dispense with drawstrings and have elasticized elements incorporated along a top portion, to aid in securing the same over the nose of the wearer.

Those skilled in the art will appreciate the various adaptations and modifications of the just-described preferred embodiments can be configured without departing from the scope and spirit of the invention. Therefore, it is to be understood that, within the scope of the appended claims, the invention may be practiced other than as is specifically described herein.

What is claimed is:

1. A bandanna convertible to a face or neck warmer, comprising:

a rectangular portion of material having at least one layer folded into a triangular configuration so as to form an elongated top portion;

a pair of securing elements held on opposite sides of the elongated top portion to secure the bandanna on a wearer;

means for tightening the top portion of the bandanna when it is secured in place on the face or neck of a wearer and a plurality of openings accommodating the means for tightening the top portion.

2. The bandanna of claim 1 wherein the means for tightening the top portion are drawstrings.

3. The bandanna of claim 2 wherein the drawstrings include outer loops to support glasses therein, and include adjustable locking elements mounted on the drawstrings.

4. The bandanna of claim 3 wherein the bandanna is made from a flexible material which is folded so as to have an outer layer, a soft inner layer and at least one filtering or insulating layer therebetween.

5. The bandanna of claim 1 wherein the bandanna has an outer layer, a soft inner layer and at least one filtering or insulating layer between the outer layer and the soft inner layer.

6. The bandanna of claim 1 wherein the bandanna, when folded, has a soft inner layer for placement against the wearer, an outer layer for protection, and at least one internal layer between the soft inner layer and the outer layer.

7. The bandanna of claim 6 wherein the soft inner layer, the outer layer and the at least one internal layer form the triangular shape of the bandanna.

8. An improved bandanna or scarf comprising:

a triangular-shaped portion of material having a wide top portion and a pointed lower portion;

a plurality of flexible, internal layers held within the triangular-shaped portion of material;

drawstrings for tightening the wide top portion of the bandanna or scarf; and loops formed on outer ends of the drawstrings to support glasses therein.

9. The bandanna or scarf of claim 8 wherein the triangular-shaped portion of material includes a soft inner face for placement against a user, and an outer face offering protection against the elements.

10. The bandanna or scarf of claim 9, further including a pair of securing elements, mounted on opposite faces of the wide top portion, to secure the bandanna on a wearer.

11. The bandanna or scarf of claim 10 wherein the drawstrings pass through openings formed in the wide top portion and are held within the bandanna or scarf; and locking elements are mounted on the drawstrings to hold the drawstrings in a tightened position.

* * * * *